United States Patent [19]

Meredith et al.

[11] Patent Number: 5,041,320

[45] Date of Patent: Aug. 20, 1991

[54] SURFACING COMPOSITION

[75] Inventors: William C. S. Meredith, Docking; Martin J. Luxton, Springwood, both of Great Britain

[73] Assignee: Hepworth Minerals & Chemicals Limited, Redhill, United Kingdom

[21] Appl. No.: 292,764

[22] Filed: Jan. 3, 1989

[51] Int. Cl.[5] ..... D04H 11/00; B32B 5/16; B32B 33/00

[52] U.S. Cl. ..... 428/87; 428/85; 428/90; 428/331; 428/404; 428/407; 428/17

[58] Field of Search ..... 428/87, 17, 85, 90, 428/331, 404, 407

[56] References Cited

U.S. PATENT DOCUMENTS

| | | | |
|---|---|---|---|
| 3,995,079 | 11/1976 | Haas, Jr. | 428/87 X |
| 4,044,179 | 8/1977 | Haas, Jr. | 428/87 X |
| 4,336,286 | 6/1982 | Tomarin | 428/17 |
| 4,337,283 | 6/1982 | Haas, Jr. | 428/17 |
| 4,389,435 | 6/1983 | Haas, Jr. | 428/87 X |
| 4,396,653 | 8/1983 | Tomarin | 428/87 X |
| 4,497,853 | 2/1985 | Tomarin | 428/17 |
| 4,819,933 | 4/1989 | Armond | 428/87 X |

FOREIGN PATENT DOCUMENTS

| | | | |
|---|---|---|---|
| 2167711 | 6/1986 | United Kingdom | 428/87 |
| 2185490 | 7/1987 | United Kingdom . | |

*Primary Examiner*—George F. Lesmes
*Assistant Examiner*—D. R. Zirker
*Attorney, Agent, or Firm*—Webb, Burden, Ziesenheim & Webb

[57] ABSTRACT

A sports surface comprises a pile fabric (11) and a layer of coated grains (13) in which the pile is partly submerged. The grains are of sand coated with a rubber.

4 Claims, 1 Drawing Sheet

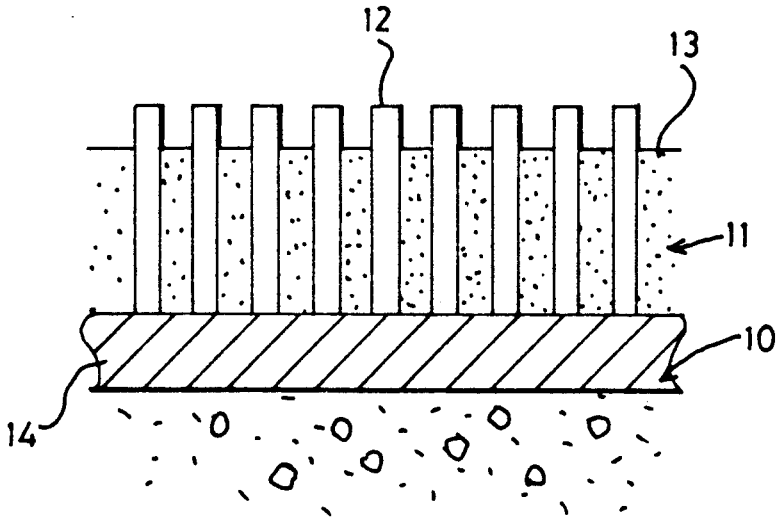
12
13
11
10
14

SURFACING COMPOSITION

BACKGROUND TO THE INVENTION

From one aspect, the present invention relates to a material suitable for use in the surfacing of the ground or of a floor, including the formation of sports surfaces, which term is used herein to embrace pitches and courts for ball games, tracks on which people, animals and machines race, landing areas for jumpers and vaulters, arenas for equestrian events, training areas and areas where recreational activities take place. Reference herein to the surfacing of the ground and of floors also includes the deliberate formation on the ground or on a floor of surface layers which have a predetermined area and are intended to be used as a surface layer, as distinct from the storage of material in a heap on the ground or on a floor. Such surface layers and sports surfaces are hereinafter referred to collectively as surfaces of the kind described.

It is known to use for the surfacing of the ground a pile fabric to form a sports surface, for example a football pitch. It has been proposed that polypropylene should be used to form the pile of pile fabric used for the purpose. It is also known to apply sand to pile fabric used for this purpose, so that lower parts of the pile are submerged in a layer of sand.

In GB 2,185,490A, published July 22nd 1987, there is described a substitute ground surface material comprising particles of sand coated with a petroleum oil fraction in which there has been dissolved ethylene vinyl acetate. The petroleum fraction is said to have a consistency proximating to a soft grease at ambient temperatures. The published specification indicates that other polymers may be substituted for the ethylene vinyl acetate. It is suggested in the published specification that particles of cork or particles of synthetic or natural rubber may be added to the treated sand.

It is an object of the present invention to provide a surfacing composition which is more suitable for sports and recreational activities in general than is the composition disclosed in GB 2,185,490A.

SUMMARY OF THE INVENTION

According to a first aspect of the present invention, a surface of the kind described comprises loose mineral grains coated with an elastomeric material. By the description "loose" we mean that the coated grains are not bonded to each other in a coherent mass as in concrete, tarmacadam or a mineral-filled plastics composition. At least prior to laying, the coated grains can be poured. During the laying process and/or subsequent use, a layer comprising the coated grains may be compacted so that the layer could no longer properly be described as pourable. However, the cohesion between adjacent grains in a surface in accordance with the present invention is a physical phenomenon, rather than a chemical bond.

A surface in accordance with the first aspect of the invention may further comprise fibrous material. Loose fibres may be mixed with the coated grains. Additionally or alternatively, the fibrous material may be incorporated in a pile fabric with the pile at least partly submerged in a layer comprising the coated grains.

The mineral grains are preferably larger than the particles of a powder. The mean of the largest dimension of each grain preferably exceeds 100 micron. Whilst, typically, the grains will not have a dimension exceeding one millimeter, larger pieces of mineral which would more properly be described as grit or gravel may be used in a composition or a surface in accordance with the invention.

The weight of elastomeric material present is preferably small, as compared with the weight of mineral. There is, however, preferably sufficient elastomeric material to coat substantially the entire surface of each grain. The weight of the coating is preferably within the range 0.2% to 10% and more preferably within the range 1% to 7% of the weight of the mineral.

According to a second aspect of the invention, there is provided a method of providing a surface of the kind described wherein mineral grains are coated with a substantially liquid polymeric composition, the coating solidifies to form a elastomeric coating and the coated grains are poured or sprayed onto the ground or a floor or onto a layer which is to be incoporated in the surface of the kind described.

DETAILED DESCRIPTION

An example of a composition in accordance with the invention and of use of that composition in a surface of the kind described will now be described, with reference to the accompanying drawing, which illustrates a vertical cross-section through a sports surface.

The sports surface illustrated in the drawing is laid on a bed 10 which may incorporate crushed stone, tarmacadam or cementitious material. There rests on the bed a pile fabric 11 which may be a pile fabric known for use on sports surfaces. The fibrous material which forms the pile 12 of the fabric may be a composition which is primarily polypropylene and which incorporates a green pigment, so that the pile resembles grass. The major part of the pile is submerged in a layer 13 which rests on the backing 14 of the pile fabric, free-end portions of the pile being exposed above the layer 13. Alternatively, the pile may be substantially entirely submerged in the layer 13. It will be noted that, in the example illustrated, the fibrous material incorporated in the surfacing layer is bound into the backing 14. Although the pile can bend, individual pile tufts cannot be displaced bodily relative to one another. In an alternative construction, there may be incorporated in the layer 13 loose lengths of fibrous material which are not bound together or to a backing.

The layer 13 comprises mineral grains coated with a polymeric material. The coated grains are loose, that is to say there is no chemical bond between adjacent grains and the grains are merely packed together in the layer 13. The layer may be compacted sufficiently to establish some degree of coherence of the layer so that the layer is not readily disturbed in use and the relationship between the pile 12 and the layer 13 which is illustrated in the drawing will generally be maintained. Alternatively, the layer 13 may not be compacted to a significant degree, so that movement of individual grains relative to one another during use will readily occur.

The mineral of the grains in the layer 13 is typically silica sand, since this is a relatively inexpensive mineral. Other mineral materials may be used, where these have physical characteristics, for example grain size, grain shape and density, which render them especially suitable for a particular application. The grains are preferably rounded grains having the characteristic which is described as medium sphericity. Typically, the bulk density of the uncoated mineral grains is in the region of 1.4 to 1.6 grammes per cc.

The uncoated mineral grains preferably have a mean larger dimension in excess of 100 micron. Generally, the grains will not have a dimension exceeding one millimetre and the mean dimension of the grains is typically within the range 250 to 850 micron.

There is present on the surface of each mineral grain a coating which covers substantially the entire surface of the grain. The coating is a polymeric coating and is preferably composed mainly of an elastomer or a mixture of elastomers organic polymer. The composition of the coating is selected according to the required properties of the surfacing, including the degree of coherence of the coated grains, when compressed, the absence of abrasive qualities and the required resilience of the surfacing. The coating may incorporate a polyolefin or a polyamide, where good resilience is not a requirement.

In a case where the surfacing is required to exhibit good resilience, for example to promote bouncing of a ball, at least a major part (by weight) of the coating on the grains of the layer 13 is constituted by an elastomer or by a mixture of elastomers. The elastomer may be a natural rubber, styrene butadiene rubber or a nitrile rubber or a composition incorporating more than one of these. In a case where the polymer is a copolymer, the proportions of the monomers incorporated in the copolymer may be varied to achieve the required resilience of the surfacing. The molecular weight of the polymeric material also may be varied to achieve required characteristics of the surfacing.

The weight of the coating is preferably within the range 0.2% to 10% of the weight of the mineral. The coating may incorporate additives which improve bonding of the coating to the mineral, for example organo silanes or organo titanates. Materials incorporating hydroxyl groups may be included in the coating to reduce the problem of freezing of the surfacing. There may be incorporated in the coating polymeric materials having free hydroxyl groups and/or glycols or other monomeric substances having hydroxyl groups. Pigments, anti-oxidants and other additives commonly used in conjunction with elastomers may be incorporated in the coating.

In one particular example, one hundred parts, by weight, of silica sand is mixed in a mixer having rotating blades with an aqueous emulsion (latex) of a synthetic rubber. The emulsion contains 50%, by weight, rubber and 4.5 parts of the emulsion are added per hundred parts of sand. The mixture is maintained at a temperature in excess of 100° C., to promote the evaporation of water and so dry the coating on each grain. The sand may be pre-heated to a temperature in the region of 140° C. and the mixture may be maintained at a temperature in the region of 140° C. for a period of several minutes, during which period the mixture is agitated vigorously. This treatment dries the coating on the grains and maintains the grains separate from one another. Maintenance of the latex at a temperature in the region of 140°–150° C. for a period of several minutes promotes cross-linking of the polymer in the coating of each grain, so that the dried grains are not tacky, but cross-linking between the coating on one grain and the coating on another grain is avoided. The dried, coated grains can be poured, although they may be somewhat less-free flowing than is dry sand.

The dried, coated sand can be stored and transported without significant cohesion of the grains one with another. In preparation of the sports surface, the pile fabric 11 is laid on the bed 10 and the dry, coated grains are then poured or sprayed onto the pile fabric. The distribution of the grains may be adjusted by brushing or raking to produce a layer of even thickness. This layer may then be consolidated by rolling. The layer 13 may be laid on the bed 10 without a pile fabric such as the fabric 11. The layer 13 may be laid directly on the ground, rather than on a specially prepared bed which has been laid in advance of the layer 13. In a case where the layer 13 is laid directly on the ground, for example to form a landing pit for jumpers and vaulters or to form a track along which horses will be ridden, the thickness of the layer 13 is typically greater than the thickness of the layer 13 when laid on a prepared bed, with or without a pile fabric.

The coated sand suffers less from compaction than does uncoated sand under the same conditions. This has been demonstrated by carrying out comparative tests on uncoated sand and on sand coated with rubber in the manner hereinbefore described. The weight of latex emulsion used to coat the sand was 0.5% of the weight of the dry sand and the sand was, in each case, Chelford 16/30 sand. This sand has the following grain size distribution.

| Mesh Size | % Retained |
|---|---|
| 1000μ | 1.5 |
| 850μ | 12.0 |
| 710μ | 28.9 |
| 600μ | 37.1 |
| 500μ | 19.8 |
| 500μ | 0.7 |

Comparative tests were carried out using the Stuttgart artificial athlete based on din 18035: part 6. In carrying out these tests, the surface of a layer of the sand was impacted ten times on the same spot at intervals of thirty seconds and the vertical displacement of the surface was recorded. In the case of uncoated sand in a wet condition, the standard deformation was 5.08 millimeter. In the case of uncoated sand in a wet, compacted condition, the standard deformation was 2.92 millimeter. The result of compacting the wet, uncoated sand is to reduce the deformation caused by impact by a relatively large proportion of the deformation caused to the uncompacted sand. In the case of wet, uncompacted, coated sand, the standard deformation was found to be 4.29 millimeter and in the case of compacted, wet, coated sand, the standard deformation was found to be 2.93 millimeter. It will be seen that the result of compacting the coated sand is a less severe change in the deformation caused by impact.

Comparative tests were also carried out using a free-falling, hemispherical impacter with a mass of 6.8 killogram and a diameter of 165 millimeter, according to the draft British Standard "Methods of Testing Playground Safety Surfacing". The impacter used in these tests has a triaxial accelerometer in a head of the impacter and this measures the total resultant deceleration of the impacter when the impact falls from a predetermined height onto the surface of a layer of the sand. The following results were obtained.

| Sample | Condition | Drop Height (m) | Severity Index | Peak g |
|---|---|---|---|---|
| Uncoated 16/30 | Wet | 1.0 | 516 | 119 |

-continued

| Sample | Condition | Drop Height (m) | Severity Index | Peak g |
|---|---|---|---|---|
| | | 1.5 | 1268 | 202 |
| | Compacted Wet | 1.0 | 610 | 133 |
| | | 1.5 | 1326 | 201 |
| Coated 16/30 | Wet | 1.0 | 477 | 114 |
| | | 1.5 | 1083 | 171 |
| | Compacted Wet | 1.0 | 608 | 131 |
| | | 1.5 | 1178 | 193 |

The comparative tests carried out in accordance with the draft British Standard show that the severity of the impact when the impacter is dropped through a height of 1.5 meter on to the surface of the sand is less in the case of compacted, coated sand, (severity index 1178) than in the case of non-compacted, uncoated sand (severity index 1268). Thus, even in a compacted condition, the coated sand is less likely to cause injury to a person landing or falling on the sand than is uncompacted, uncoated sand.

In a case where the polymeric material to be incorporated in the coating is not readily soluble or dispersable in water, the polymeric material may be brought into a substantially liquid condition, in order to form the coating, by melting or by solution in a non-aqueous solvent. For example, the sand and the polymer in a powder form may be mixed together and heated to coat the sand. Vigorous agitation may be used to avoid cohesion of the coated grains one with another.

What we claim is:

1. A sports surface comprising, in combination:

a pile fabric including a backing and an upstanding pile attached to the backing; and a layer of loose mineral grains separately coated with an elastomeric material deposited on said backing to a depth wherein said upstanding pile is at least partially submerged therein.

2. A surface according to claim 1 wherein the mean of the largest dimensions of the grains exceeds 100 micron.

3. A surface according to claim 1 wherein the weight of the coating is within the range 0.2% to 10% of the weight of the grains.

4. A method of constructing a sports surface comprising the steps of:

providing a pile fabric having an upstanding pile of fibrous material;

coating separate mineral grains with a substantially liquid polymeric composition;

solidifying the liquid polymeric composition to form a dry elastomeric coating on the separate mineral grains; and depositing a layer of said coated mineral grains on said pile fabric wherein the fibrous material of the pile is at least partially submerged and remains upstanding in said layer of coated mineral grains.

* * * * *